US007918974B2

(12) United States Patent
Bäumer et al.

(10) Patent No.: US 7,918,974 B2
(45) Date of Patent: Apr. 5, 2011

(54) MICRO-STRUCTURED INSULATING FRAME FOR ELECTROLYSIS CELL

(75) Inventors: Ulf Bäumer, Dormund (DE); Randolf Kiefer, Bochum (DE); Karl Heinz Dulle, Olfen (DE); Stefan Oelmann, Hemer (DE); Peter Woltering, Neuenkirchen (DE); Wolfram Stolp, Hamm (DE)

(73) Assignee: Uhdenora S.p.A., Milan (IT)

( * ) Notice: Subject to any disclaimer, the term of this patent is extended or adjusted under 35 U.S.C. 154(b) by 190 days.

(21) Appl. No.: 12/226,100

(22) PCT Filed: Apr. 27, 2007

(86) PCT No.: PCT/EP2007/054177

§ 371 (c)(1),
(2), (4) Date: Oct. 7, 2008

(87) PCT Pub. No.: WO2007/125107

PCT Pub. Date: Nov. 8, 2007

(65) Prior Publication Data

US 2009/0159435 A1 Jun. 25, 2009

(30) Foreign Application Priority Data

Apr. 28, 2006 (DE) ..... 10 2006 020 374

(51) Int. Cl.
*C25B 9/00* (2006.01)

(52) U.S. Cl. ..... 204/279; 204/252; 204/263

(58) Field of Classification Search ..... 204/279, 204/263, 252

See application file for complete search history.

(56) References Cited

U.S. PATENT DOCUMENTS

| | | | | | |
|---|---|---|---|---|---|
| 4,313,812 | A * | 2/1982 | Kircher | 204/253 |
| 4,332,661 | A * | 6/1982 | Ford et al. | 204/253 |
| 4,342,460 | A * | 8/1982 | Eng | 277/312 |
| 4,431,495 | A * | 2/1984 | Fair et al. | 205/513 |
| 4,469,571 | A * | 9/1984 | Fair et al. | 205/513 |
| 4,664,770 | A * | 5/1987 | Schmitt et al. | 204/252 |
| 4,822,460 | A * | 4/1989 | Beaver | 205/350 |
| 4,824,542 | A * | 4/1989 | Burgess | 204/253 |
| 4,851,099 | A * | 7/1989 | Brereton | 204/256 |
| 5,194,132 | A * | 3/1993 | Hartmann et al. | 204/257 |
| 6,117,287 | A * | 9/2000 | Molter et al. | 204/255 |
| 6,282,774 | B1 * | 9/2001 | Borucinski et al. | 29/592.1 |
| 6,503,377 | B1 * | 1/2003 | Borucinski et al. | 204/257 |
| 6,585,869 | B2 * | 7/2003 | Shiepe et al. | 204/252 |
| 7,351,317 | B2 * | 4/2008 | Dulle et al. | 204/266 |
| 7,785,453 | B2 * | 8/2010 | Dulle et al. | 204/283 |
| 2005/0077068 | A1 * | 4/2005 | Gestermann et al. | 174/50 |
| 2005/0183951 | A1 * | 8/2005 | Oldani et al. | 204/279 |
| 2006/0006062 | A1 * | 1/2006 | Dulle et al. | 204/263 |
| 2007/0240978 | A1 * | 10/2007 | Beckmann et al. | 204/242 |
| 2008/0116081 | A1 * | 5/2008 | Dulle et al. | 205/618 |
| 2009/0236220 | A1 * | 9/2009 | Woltering et al. | 204/252 |

* cited by examiner

*Primary Examiner* — Bruce F Bell
(74) *Attorney, Agent, or Firm* — Charles A. Muserlian

(57) ABSTRACT

The invention relates to an insulating frame of an electrolysis cell having a microstructured internal section allowing the penetration of the electrolyte even if the structured section is partly or completely overlapped by the membrane, and to an electrolysis cell equipped with the same.

12 Claims, 3 Drawing Sheets

MICRO-STRUCTURED INSULATING FRAME FOR ELECTROLYSIS CELL

This application is a 371 of PCT/EP2007/054177 filed Apr. 27, 2007

BACKGROUND OF THE INVENTION

The invention relates to a component for membrane electrolysis cells, and is particularly directed to an insulating frame provided with a structured internal section allowing the penetration of a process electrolyte also in the regions in direct contact with the membrane. Under another aspect, the invention is directed to an electrolysis cell equipped with such micro-structured insulating frame.

Several types of electrolysis cells for the production of chlorine and hydrogen gas and/or caustic soda solution are known in the art. In particular, the most common cell designs in existing industrial applications are the filter-press type and the "single cell element" type, in which the elements are electrically connected in series.

The single cell element design, which is for instance disclosed in DE 102 49 508 A1 and DE 10 2004 028 761 A1, is comprised of anodic or cathodic semi-shells housing the respective anode and cathode. An ion-exchange membrane is positioned between the electrodes and kept in place by suitable flanges. As specified in DE 10 2004 028 761 A1, an insulating frame is arranged between the flange of the anodic semi-shell and the membrane, so that the membrane is clamped between the surfaces of the cathodic semi-shell and the insulating frame and held in position accordingly.

Since the membrane, which typically comprises a sulphonic layer and a carboxylic layer, is not tensioned during the cell assembly procedure but is simply placed horizontally on one of the semi-shells, the insulating frame also serves to prevent it from oscillating and coming in contact with the metallic surfaces of the anodic semi-shell during operation. In this regard, the transitional area between the anodic semi-shell and the flange is of special importance to prevent short-circuits and to protect the membrane from damages. For the above reasons, the insulating frame is oversized so that it protrudes by a few millimetres into the internal compartment and separates the membrane from the adjacent metallic surfaces of the semi-shell.

The detrimental effect of this safety measure is the deactivation of the membrane in the contact area. Since the pressure in the cathodic compartment is higher than that in the anodic compartment, the membrane is pressed towards the anodic compartment and/or against the protruding region of the frame, and thus it can be wetted only on the opposite side in the contact area.

On account of this blinding phenomenon on the anode side, the hygroscopic caustic solution present on the cathode side tends to dehydrate the membrane in this region, thus causing precipitation of salts in the carboxyl layer eventually leading to blistering, delamination of the two membrane layers and/or fissuration phenomena. These damages are sometimes visible, but they may also be detected by a high chloride concentration in the caustic product, owing to the migration of chloride ions to the cathodic compartment by diffusion through the damaged area. The efforts carried out so far to overcome this detrimental effect by improving the sizing or the positioning of the insulating frame were not satisfactory, so that either a higher chloride concentration is tolerated for long periods or the membrane has to be replaced more frequently.

It is one of the objects of the present invention to reduce damage to the peripheral region of the membrane by minimising the flux of chloride ions to the cathode side or by preventing it at all.

This and other objects which will be evident to those skilled in the art are achieved by the technical solution disclosed in the appended claims.

DESCRIPTION OF THE INVENTION

In one embodiment, the present invention is directed to an insulating frame for electrolysis cells provided with a flat portion comprised of an anode side and a cathode side and having an external and an internal abutting surface, comprising an outer edge portion adjoining the internal abutting surface and structured so that it can be penetrated by an electrolyte in the case of partial or complete coverage or overlapping. In one preferred embodiment, the edge portion is a micro-structured surface. Preferably, this edge portion is continuous and runs along the whole perimeter of the internal abutting surface.

In one preferred embodiment, the outer edge portion is in form of a flat step provided with a multiplicity of variously shaped projections; advantageously, such projections are in form of cylindrical or spherical protrusions.

In another embodiment, the outer edge portion is provided with a series of undulated or notched protrusions and depressions, whose structure is configured such that the undulations or notches are open along the width of the frame, so that the anolyte can flow or diffuse back and forth from the anodic compartment to this region. In a particularly preferred construction, the undulations or notches are provided with a multiplicity of small openings improving the passage of the anolyte in the two directions. Such openings can be shaped as holes, groove recesses or any other suitable geometrical form.

In one embodiment of the insulating frame in accordance with the present invention, an additional advantageous feature is given by a multiplicity of small openings, bores or holes located in the outer edge portion and penetrating the whole thickness of the insulating frame. Said openings are in mutual fluid communication through channels provided in the surface of the insulating frame, preferably arranged on the anode side, that is on the side opposed to the membrane. The channels putting the openings in fluid communication with each other or with the internal abutting surface may be advantageously provided on both of the flat portions of the insulating frame. The presence of this channel structure on both sides enhances the feed and discharge of the anolyte.

A further benefit of this configuration is that it allows larger manufacturing and assembly tolerances.

Under another aspect, the present invention is directed to an electrolysis cell comprising an insulating frame as above described for sealing the two semi-shells of the cell and/or holding the membrane in place.

DETAILED DESCRIPTION OF THE DRAWINGS

Figure 1:
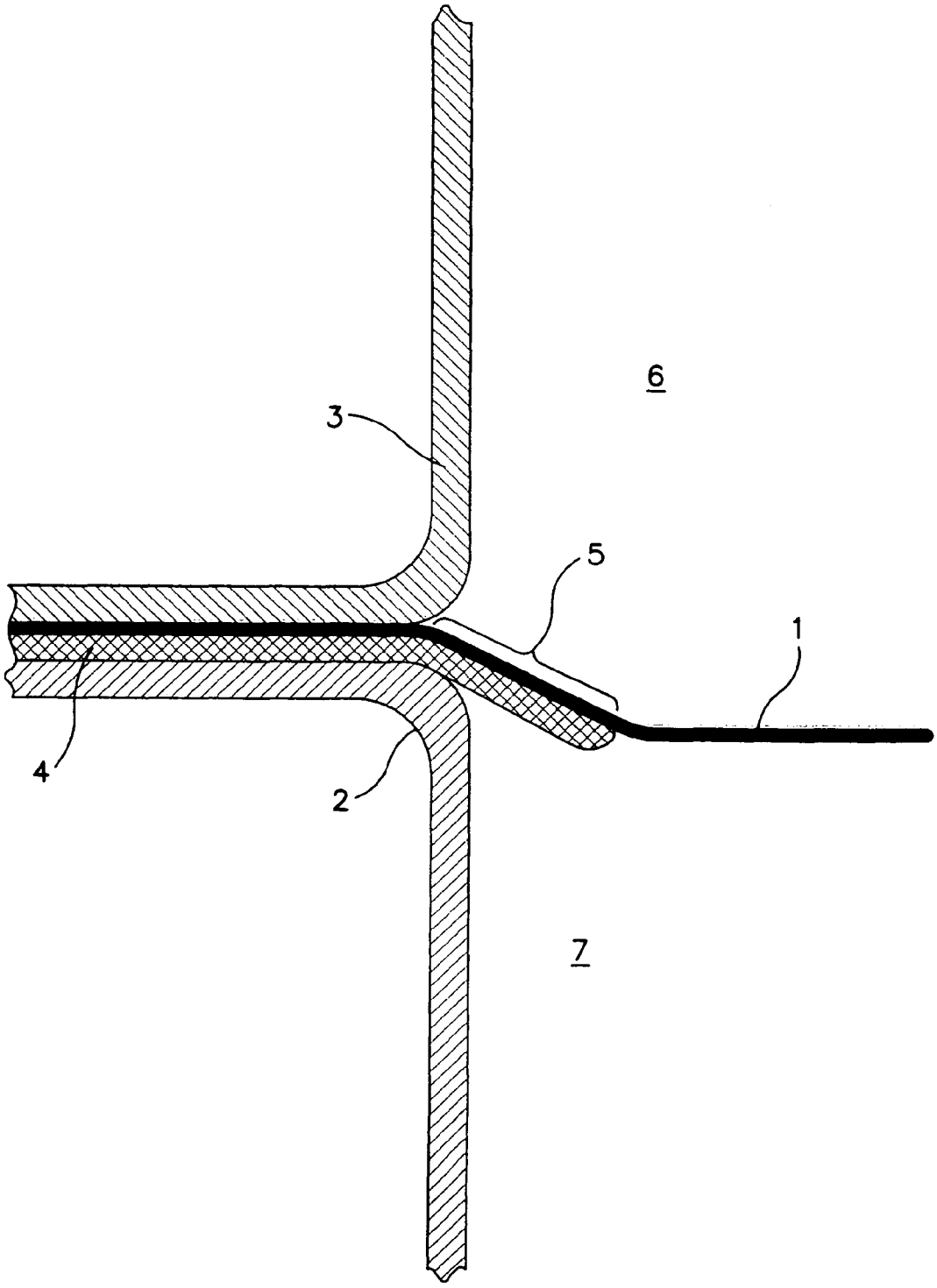
Fig. 1 PRIOR ART
FIG. 1 shows a section of the flange area of an electrolysis cell of the prior art.

FIG. 1 shows a section of the flange area of an electrolysis cell as known in the art. The membrane 1 is clamped between the two flanges of the anodic semi-shell 2 and of the cathodic semi-shell 3, with an insulating frame 4 being placed between anodic semi-shell 2 and membrane 1. In the case of a standard assembly, a region 5 of insulating frame 4 protrudes into the interior of the electrolysis cell.

Since the pressure inside the cathodic compartment 6 is 20 to 40 mbar higher than that inside the anodic compartment 7, the membrane 1 is pressed against the protruding region 5 of the frame and locally can no longer be wetted by the anolyte coming from the anodic compartment 7.

Figure 2:
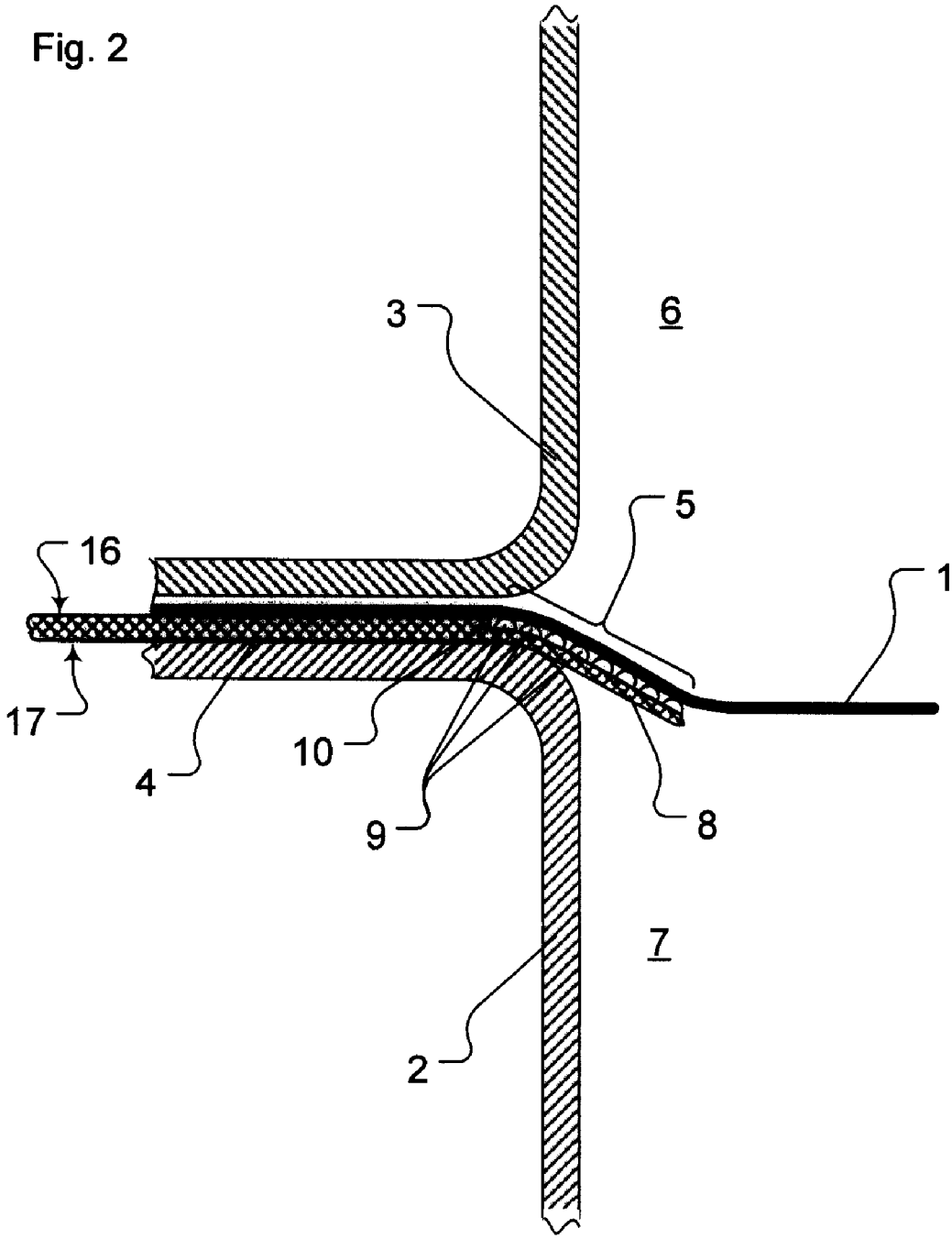
FIG. 2 shows a section of the flange area of an electrolysis cell including an insulating frame according to the invention.

FIG. 2 shows an equivalent section of the flange area of an electrolysis cell wherein an insulating frame in accordance with the invention is installed: the insulating frame 4 is shaped as a step, wherein the step edge 10 in correspondence with the outer edge portion 8 has a reduced thickness than the surrounding area. In order to keep the membrane 1 in a hydrated condition, a multiplicity of spherical protrusions 9 are arranged in the outer edge portion 8, said protrusions 9 providing support to the membrane 1, without completely blinding the membrane side facing the anode compartment 7 remains partially uncovered.

In this case the insulating frame 4 and the step edge 10 are positioned such that said edge 10 is located within the flange area of the two semi-shells. Hence, upon installation the membrane 1 is squeezed off at the edge 10 and deactivated on either side so that a unilateral wetting is precluded and deterioration of the membrane is prevented. Unlike the design of the prior art shown in FIG. 1, in this case the protruding region 5 of the frame may be manufactured and assembled with larger tolerances.

Figure 3A:
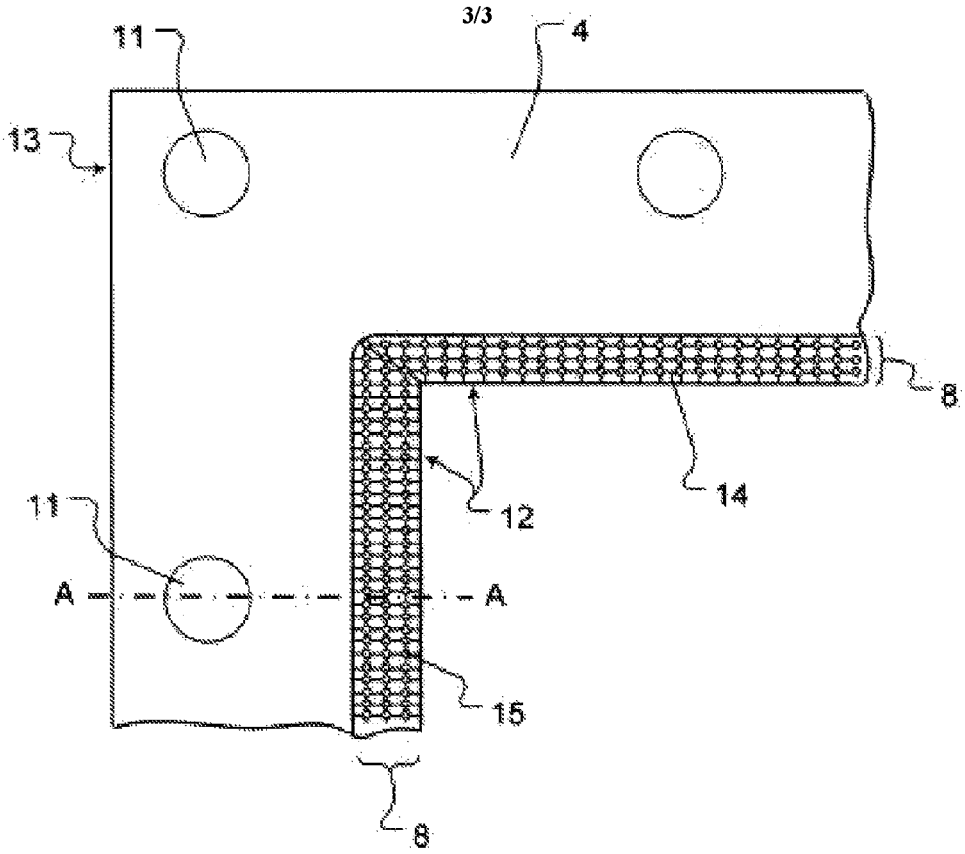
FIGS. 3*a* and 3*b* show constructive details of one embodiment of the insulating frame according to the invention.

FIG. 3*a* illustrates the top view of a corner of the insulating frame 4 in accordance with the invention, provided with channels 14 and small openings 15. The outer edge portion 8 between the outer abutting surface 13 and the inner abutting surface 12 is provided with a multiplicity of openings 15 in reciprocal fluid communication through micro-channels 14 running along the transversal and the longitudinal direction, shown as lines. The larger openings 11 outside the outer edge portion 8 are intended for the clamping bolts used to tighten the flange (not shown).

Figure 3B:
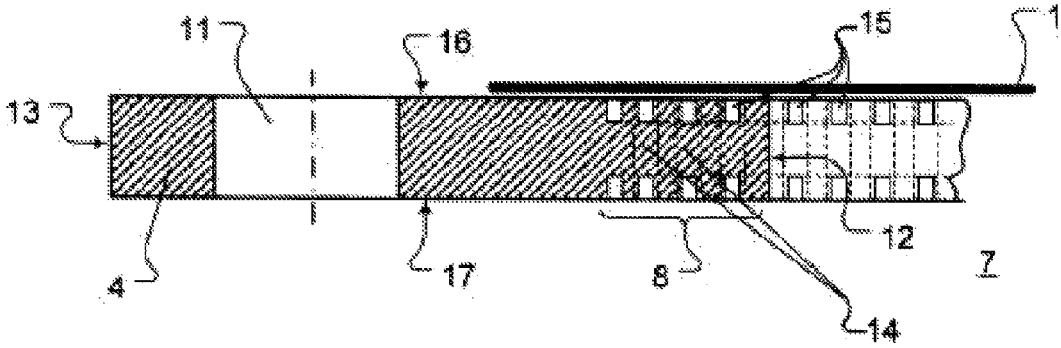

FIG. 3*b* illustrates a magnified detail of insulating frame 4 along the sectional line A-A of FIG. 3*a*. It is shown that the anode side 17 is shaped in an equivalent manner to the cathode side 16 and that micro-channels 14 are provided on both sides of the insulating frame and arranged in a network to put the openings 15 in reciprocal fluid communication. The micro-channels 14 arranged perpendicularly to the internal abutting surface 12 are open in the direction of the anodic compartment 7 so that the anolyte can penetrate the network of channels, flowing across the openings 15 to finally reach the membrane side facing the anodic compartment 7.

EXAMPLE

For the purpose of comparison, an industrial electrolysis cell with a membrane surface area of 2.7 $m^2$ was operated in standard conditions at a current density of 6 $kA/m^2$, monitoring the chloride concentration in the caustic product. The initial value of chloride concentration in the product caustic soda ranged between 14 and 20 ppm, and started to increase slowly after approximately 200 days of operation, exceeding a value of 50 ppm after about one year.

After a period of 150 days it was already possible to observe the onset of blistering on the outer edge of the membrane.

An equivalent electrolysis cell with a membrane surface area of 2.7 square meters equipped with an insulating frame made in accordance with the present invention was subjected to a similar duration test.

No increase in chloride concentration was observed after 200 days of test; more importantly, no blistering phenomenon occurred during the whole testing period. The latter aspect is a reliable indication that the chloride concentration in the cathode compartment remained at low levels for the whole time, allowing to extend the membrane lifetime.

The above description shall not be understood as limiting the invention, which may be practised according to different embodiments without departing from the scope thereof, and whose extent is exclusively defined by the appended claims. In the description and claims of the present application, the word "comprise" and its variations such as "comprising" and "comprises" are not intended to exclude the presence of other elements or additional components.

The invention claimed is:

1. An insulating frame for an electrolysis cell provided with a flat portion comprised of an anode side and a cathode side and having an external and an internal abutting surface, wherein an outer edge portion adjoining said internal abutting surface is structured so that it can be penetrated by an electrolyte in the case of partial or complete coverage or overlapping.

2. The frame of claim 1 wherein said outer edge portion has a micro-structured surface.

3. The frame of claim 1 wherein said outer edge portion is continuous and runs along the whole perimeter of said internal abutting surface.

4. The frame of claim 1 wherein said outer edge portion is shaped as a flat step comprising a multiplicity of projections.

5. The frame of claim 4 wherein said projections are in the form of cylindrical or spherical protrusions.

6. The frame of claim 1 wherein said outer edge portion is provided with a series of undulated or notched protrusions and depressions.

7. The frame of claim 6 wherein said undulated or notched protrusions and depressions are open along the width of the frame.

8. The frame of claim 1 wherein said outer edge portion is provided with a multiplicity of openings.

9. The frame of claim 8 wherein said openings are shaped as holes or groove recesses.

10. The frame of claim 8 said openings are in fluid communication with each other through channels provided on at least one side of the outer edge portion.

11. The frame of claim 10 wherein said at least one side of the frame provided with channels is the anode side.

12. An electrolysis cell comprising an anodic compartment and a cathodic compartment subdivided by a membrane wherein it further comprises an insulating frame of claim 1.

* * * * *